United States Patent [19]

Page, Jr.

[11] 4,005,751

[45] Feb. 1, 1977

[54] DEEP WELL SAFETY VALVE

[76] Inventor: John S. Page, Jr., 10424 Echo River Court, Fountain Valley, Calif. 92708

[22] Filed: Apr. 11, 1975

[21] Appl. No.: 567,376

[52] U.S. Cl. ..... 166/321; 251/28

[51] Int. Cl.[2] ..... E21B 43/00

[58] Field of Search ..... 166/72, 224 R, 224 A; 251/28, 29, 62, 63

[56] References Cited

UNITED STATES PATENTS

| | | | |
|---|---|---|---|
| 2,751,923 | 6/1956 | Towler et al. | 251/28 |
| 3,298,390 | 1/1967 | DeGraaf | 251/29 |
| 3,313,350 | 4/1967 | Page, Jr. | 166/224 A |
| 3,361,212 | 1/1968 | Page, Jr. | 166/224 A |
| 3,662,824 | 5/1972 | Page, Jr. | 166/72 |

*Primary Examiner*—James A. Leppink
*Attorney, Agent, or Firm*—William W. Haefliger

[57] ABSTRACT

A surface controlled, sub-surface well valve includes a main valve, a main valve actuator, and a control pressure responsive pilot valve to control application of control pressure to the actuator. The construction is such that the well valve is not affected by changes in pressure of the production flow, or excessive static control pressure in relation to production flow pressure, and irrespective of the depth at which the valve is installed in the well.

19 Claims, 5 Drawing Figures

119
118
107
105
120
113
115
128
133
114
121
122
104
143
142
131
141
130
140
129
123
127
117
108
112
116
126
104a
145
125
144
124
137
138
t
201
100
101
102
103
100a
104b
109
108a
111
106
110
107

97
95
10b
12
11
60
96
51
13
16
43
42
72
27a
34
73
46
33
40
37
49
48
27
35
56
19d
29
27a
90
92
32
14
91
26
10a

DEEP WELL SAFETY VALVE

BACKGROUND OF THE INVENTION

This invention relates generally to controlling the upward flow of production in a well, and more particularly concerns the fluid pressure control from the surface of sub-surface valves, particularly in deep wells, in such manner as to obviate the effects of excessive control pressure due to well depth.

In the past, production flow controlling sleeve valves have been constructed to take advantages of the pressure of the production flow to urge the valve sleeve in one direction between open and closed positions. While this was in certain instances satisfactory, serious problems can arise when the pressure of the production flow varies, as for example can occur with the valve at a fixed installation depth, and also when the valve is moved up or down in the well. For example, if the production flow pressure increases greatly, then it requires much more control pressure to overcome the effect of increased production flow pressure on the valve sleeve, in order to shift the valve sleeve in the opposite direction, or to maintain the valve in open condition, for example. Also, excessive static control pressure that tends to maintain the valves open is a problem, particularly in deep wells. These conditions in turn serve to limit the depths at which said sleeve type safety valves can be usefully installed, and also requires monitoring of such valves and adjustment of control pressure application to make sure that they remain in desired open or closed state.

SUMMARY OF THE INVENTION

It is a major object of the invention to provide a surface controlled, sub-surface safety valve characterized in that it is not affected by changes in the pressure of the production flow, or excessive static control pressure in relation to production flow pressure, and irrespective of the depth at which the valve is installed. Basically, the invention is embodied in the combination that includes a. a housing connectible in a well tubing string, the housing having opposite ends, b. a main valve and an actuator therefor, the actuator carried for movement relative to the housing to displace the main valve between open and closed positions to control production fluid flow upwardly relative to the housing, and c. pilot valve means positioned to block application of the control pressure that would act to shift the main valve to open position at certain times when the control pressure exceeds the well fluid pressure, the pilot valve means being shiftable relative to the housing in response to an increase in the control fluid pressure to unblock application thereof acting to shift the main valve to open position at other times when the control pressure exceeds the well fluid pressure.

As will appear, the main and pilot valves may comprise sleeves, which may be supported on a carrier, the latter being wire line retrievable; the main and pilot valves may be pressure balanced or approximately so, and a small control spring may be employed to bias the pilot valve to set the control pressure at which the pilot valve is shiftable to effect opening of the main valve, despite the fact that the control pressure exceeds the production fluid pressure. Further, the use of auxiliary weighting as disclosed in my co-pending application Ser. No. 513,470, filed Oct. 9, 1974, may thereby be avoided, whereby a compact, simple, reliable, deep well safety valve (surface controlled) is provided.

These and other objects and advantages of the invention, as well as the details of an illustrative embodiment, will be more fully understood from the following description and drawings, in which:

DRAWING DESCRIPTION

FIG. 1*a* and 1*b* are vertical half sections showing one form of the invention;

DETAILED DESCRIPTION

Figure 1A:
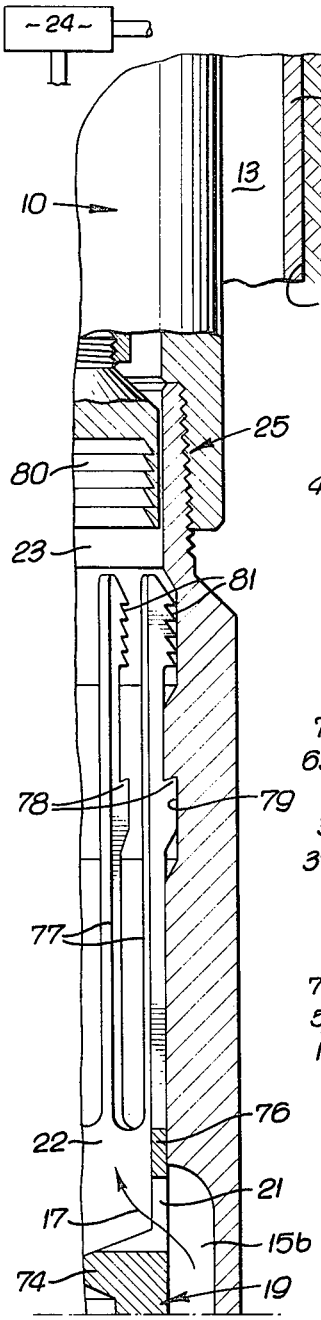
Figure 1B:
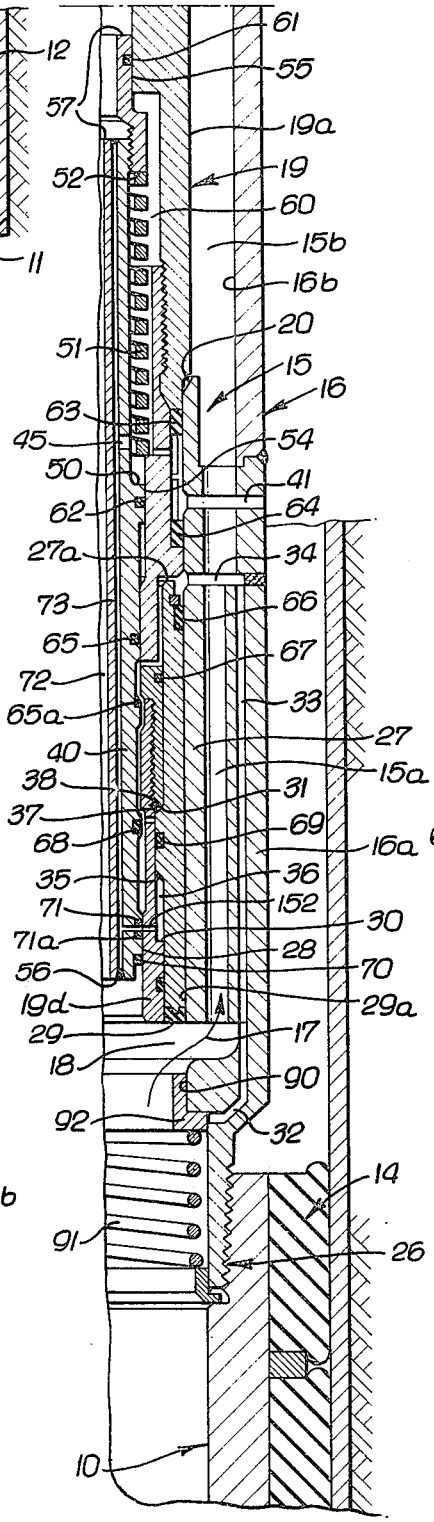

Referring first to FIGS. 1*a* and 1*b*, a tubing string 10 is located in a well 11 provided with casing 12. The annulus 13 between the string and casing is packed off at 14 below the level of a side passage 15 in a valve housing 16 connected in series with the string. In main valve open condition, the upward flow of production fluid in passage 15 is represented by arrows 17. That passage includes, in upward sequence, annularly spaced, vertical openings 15*a* drilled in housing or body section 16*a*, and annular passage extent 15*b* formed between housing inner wall 16*b* and the outer wall 19*a* of an insert tubular carrier 19 recessed into and landed in the housing at shoulder 20. Upper port 21 returns the upward flow from the upper end of the passage extent 15*b* into the housing interior at 22 and the upper tubing string interior at 23 for ultimate collections and distribution at the surface, via means indicated schematically at 24. Accordingly, the valve may be considered a tubing to tubing, sub-surface, surface controlled valve. Note that the housing has upper and lower threaded ends 25 and 26 connected with the tubing.

In accordance with the invention, a main valve is carried for movement relative to the housing between open and closed positions to control production fluid flow between opposite ends of the housing, as via passage 15. The main valve may with unusual advantage comprise a sleeve 27 carried by the removable carrier 19 for movement between up position shown in solid lines, in which annular port 18 is open, and down position shown by broken lines 27*a* in FIG. 2, in which port 18 is then closed.

The main sleeve valve 27 is slidably carried at 28 by the lower stem 19*d* of the carrier, and an annular seal 29 at the lower end of the sleeve valve packs off between that stem and the housing inner wall 29*a*, in up position of that valve. Note that shoulders 30 and 31 associated with stem 19*a* limit up and down stroking of the main valve 27. Also, the main valve is flow pressure balanced, as by exposing vertically opposite end surfaces to production fluid pressure. Thus, lower end surface or seal 29 is exposed to flow pressure, and the upper end surface at 27*a* is exposed to pressure communicated via ports 32, 33 and 34. For actuating the main valve, piston surface 35 thereon receives control fluid pressure communicated to chamber 36 to displace the valve upwardly, and piston surface 37 receives control fluid pressure communicated to chamber 38 to displace the valve downwardly. Surfaces 35 and 37 may be considered as an actuator for the main valve, whatever form the latter may take.

Further in accordance with the invention, pilot valve means is positioned to block application of the control pressure that would act to shift the main valve to open position at certain times when the control pressure exceeds the well fluid pressure, the pilot valve means being shiftable relative to the housing in response to an increase in control pressure to unblock application thereof acting to shift the main valve to open position at other times when the control pressure exceeds the well fluid pressure.

Figure 2:
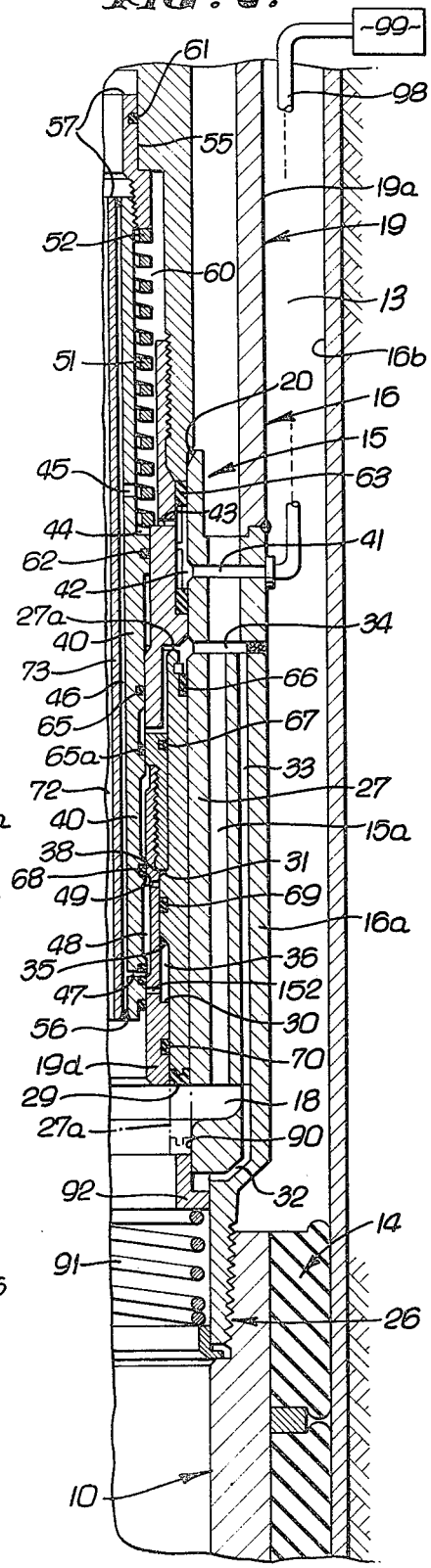
FIG. 2 is a vertical half section like FIG. 1*b* showing a shifted pilot valve condition.

In the example, the pilot valve means comprises a vertically movable sleeve 40 having an up-position as seen in FIG. 2 in which control fluid pressure is communicated to the main valve 27 tending to displace it to closed position. For this purpose, control pressure may be transmitted via side port 41 in the housing to the main valve piston surface 37 via passages 42 and 43, chamber 44, port 45, passage 46 and port 47, passage 48 and port 49 to chamber 38. In this regard, control pressure may be supplied in the annulus 13 by pressurizing same, or via a single control line 98 communicating with a pressure source 99 at the surface. The pilot valve sleeve 40 also has down-position as seen in FIG. 1*b* in which control pressure is communicated to the main valve 27 tending to displace it to up or open position. For this purpose control pressure may be transmitted via passages and ports 41 to 47 to port 152 in carrier extent 19*d*, and then to the chamber 36 and main valve piston surface 35.

The pilot valve has a first piston surface as at 50 to receive application of control pressure to shift the pilot valve to down position when the control pressure exceeds a predetermined level P. In this regard, compression spring 51 is typically employed to normally urge the pilot valve into up-position, the spring sized to be overcome when the control pressure exceeds the predetermined level P. The pilot valve also has a second piston surface, as at 52, to receive application of control pressure tending to shift the pilot valve toward up-position. In this regard, the control pressure receiving effective area of the first piston surface exceeds the control pressure receiving effective area of the second piston surface, this relationship corresponding to the fact that the outer diameter $d_1$ of the pilot valve surface at 54 exceeds the outer diameter $d_2$ of the pilot valve at 55. Note that spring 51 is located in chamber 60 formed between the pilot valve sleeve and the carrier 19, and exposed to control fluid pressure at ports 41–44.

The pilot valve also has oppositely facing surfaces as at 56 and 57 exposed to receive production fluid pressure, the effective areas of such surfaces being equal so that the pilot valve is also pressure balanced with respect to production fluid pressure.

Additional structure in FIGS. 1*b* and 2 includes seals 61–71, as shown, enabling isolation of control fluid pressure from production fluid pressure. The latter gains access to pilot valve surface 57 via a bore 72 in a tube 73 attached at both ends to the pilot valve 40 to isolate port 46 from production fluid. The carrier end wall 74 acts as a plug blocking off the interior of the tubing above the carrier from the tubing interior below the carrier. The carrier is supported by a collet 76 having spring fingers 77 releasably attached to the housing or sub 16. For this purpose, the fingers may have latches 78 receivable within annular grooving 79 in the housing, the latching engagement occurring upon downward landing of the carrier within the housing. A pulling tool 80 may be lowered into the string via wire line to engage the external serrations 81 on the upper extrusions of the spring fingers. In this process, the fingers are cammed inwardly to unlatch them from the grooving 79, and the carrier 19 may thereby be upwardly retrieved, whereby the well may be produced through the string.

In operation of the pilot and main valves, assume first that the main valve is in FIG. 2 closed position, that the well is sufficiently deep (say, 7,000 feet for example) and that the production fluid static pressure is, say 3,000 psi. Assume also that the control pressure is greater than the production fluid pressure, but not sufficient to shift the pilot valve downwardly. As the control pressure is increased, as by operation of means 99 at the surface, for example, it will reach a level (say 4,000 psi) which is sufficient to overcome spring 51 and shift the pilot valve downwardly to FIG. 1*b* position, allowing control pressure to reach the main valve piston surface 35 to shift that valve upwardly as shown in FIG. 1*b*, opening passage 15 for by-passing production flow from the tubing below the valve to the tubing above the valve. The above specific valves are illustrative only.

Of advantage is the fact that the invention allows the static control pressure to exceed production fluid pressure, with the main valve remaining closed until such time as the control pressure is increased to an even higher and predetermined level. This allows use of the valve in deep wells, and overcomes problem with prior valves wherein the valve would open if the static control pressure exceeded the production fluid pressure. Another advantage lies in the use of a relatively small spring 51 as compared with prior valves wherein a large spring was required to bias the main valve.

It is clear from what has been said that the valve may be used in many different well depths environments, since the pilot valve may be opened or closed to control the main valve irrespective to the production fluid pressure.

Referring again to certain seals, one-way seal 65*a* is used to prevent well pressure from leaking downwardly in FIG. 2 toward and past seal 68 and then out port 152 to chamber 36, and/or to passage 46 and ports 45 and 46 to the annulus or control line; seal 68 is a one-way seal to prevent pressure from passing upwardly in FIG. 2; seals 71 and 71*a* respectively block pressure passage upwardly and downwardly in FIG. 1; and seal 70 blocks upward pressure passage, while allowing excess fluid in chamber 36 to be forced downwardly into the well. Seal 70 may be a U-shaped cup type seal.

It should also be noted in FIGS. 1*b* and 2 that when the main valve 27 is in down or closed position, the annular seal 29 at its lower end engages or wipes the sideward facing annular sealing surface 90 on the housing, and when the main valve is in up or open position, a compression spring 91 urges a sleeve 92 upwardly adjacent that surface 90. Valve 29 pushes the sleeve downwardly, in FIG. 2.

Figure 3:
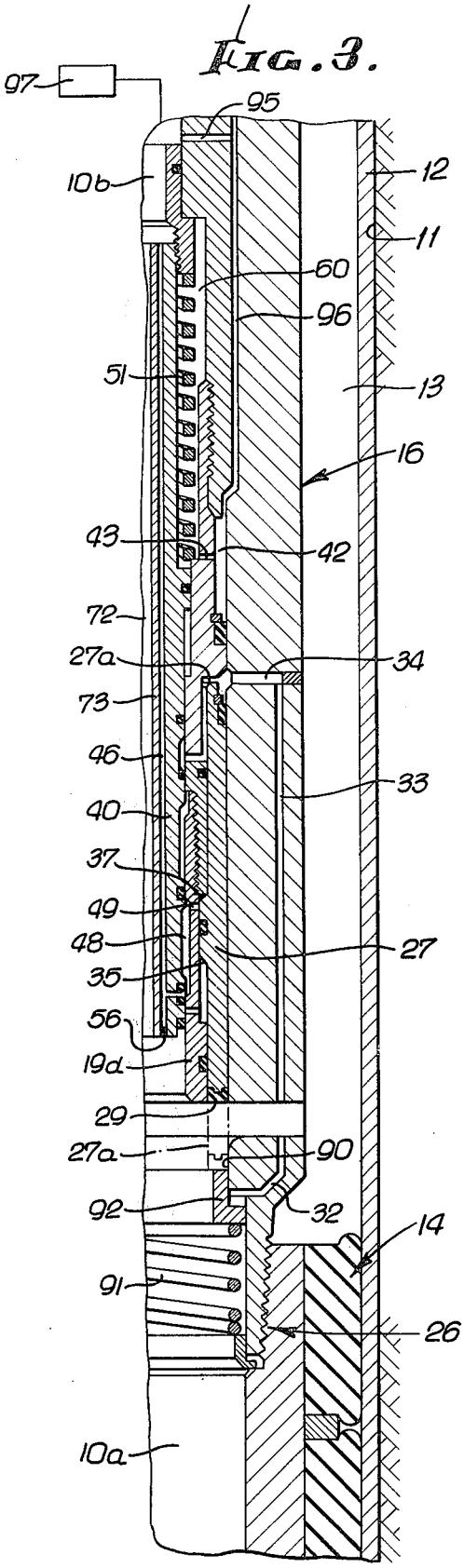
FIG. 3 is a vertical section like FIG. 1*b* but showing a modification.

Turning to FIG. 3, the construction is the same as in FIGS. 1 and 2, except for certain structural variations which enable operation of the valve in tubing to annulus flow mode. Thus, the valve main sleeve 27 controls upward production flow from the tubing interior 10*a* below the valve to the annulus 13. In this regard, elements which are the same as those in FIGS. 1 and 2 are given the same identifying numbers.

Control pressure is exerted downwardly from the tubing interior 10b above the valve, to operate the pilot valve. Thus, for example, control pressure is communicated to passages 42 and 43, for purposes as explained above, via radial passage 95 in the carrier, and longitudinal passage 96 formed between the carrier and housing 16. A surface source of control pressure (corresponding to that at 99 in FIG. 2) is indicated at 97.

Figure 4:
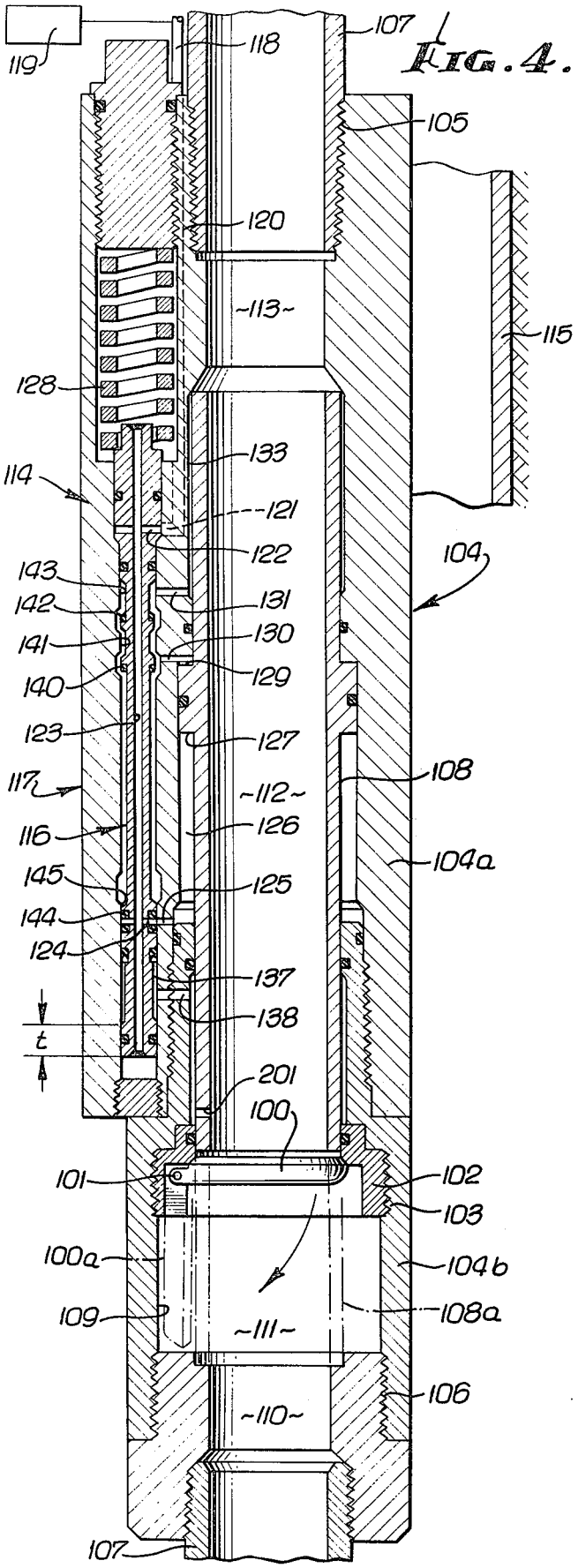
FIG. 4 is full vertical section showing another form of the invention.

In the modification seen in FIG. 4, the main valve comprises a flapper 100 pivotally connected at 101 to an insert 102 having threaded connection at 103 to section 104b of the housing or sub 104. The latter is connected at 105 and 106 to the tubing string 107. A valve actuator sleeve 108 is movable from up position as shown in full lines to down position as shown broken lines 108a to swing the flapper downwardly and sidewardly to broken line position 100a in a recess 109 formed by housing section 104b. As a result, a vertically open straight passage is formed by the bores 110, 111, 112 and 113, as shown, to pass production flow, sand, rocks, etc., upwardly and without restriction in the tubing. The latter extends vertically within well casing 115.

The main valve actuator sleeve 108 is controlled by a pilot valve unit 114, in a manner somewhat similar to that described above in FIGS. 1 and 2; however, in this case the pilot valve itself comprises an elongated tubular spool 116 movable vertically within a auxiliary housing 117 attached to the side of the main housing 104 so as not to interfere with the main flow passage provided by bores 110–113 as described above. In the "down" spool position shown, control pressure exerted downwardly via a single control line 118, as from a surface source 119, passes via ports 120–122 to the vertical bore 123 in the spool 116. The pressure then passes via side port 124 in the spool and side port 125 in the housing section 104a to a lower chamber 126. Pressure in that chamber is exerted downwardly against downward facing piston surface 127 on the actuator 108, shifting the actuator to up-position. Fluid trapped above upward facing piston surface 129 vents to the bore 113 via passages 130–133. Under the latter condition, the flapper valve 100 may be urged to up or closed position, as by a torsion spring, not shown. Control line 118 may be attached to tubing 107.

A "regulating" compression spring 128 within housing 117 urges the pilot valve spool to "down" position, as shown. When the control pressure is increased to a predetermined level, as for example above the level of production fluid pressure in bores 110 and 111 below the flapper valve 100, the spool 116 is shifted upwardly by an amount indicated at *t* to cause control pressure to be communicated via side port 124 in the upwardly shifted spool to passage 124. From the latter, pressure is communicated via port 130 to the chamber above upward facing piston surface 129 of the actuator sleeve 108, driving that sleeve downwardly to displace the flapper to open position. Fluid trapped in lower chamber 126 then flows via side port 125 and passages 137 and 138 to the bore 112, via port 201. In spool up-position, annular seal 140 seals off against bore 141; annular seal 142 seals off at bore 143; and annular seal 144 becomes unsealed off bore 145.

I claim:

1. In a well valve to control the upward flow of well production fluid and to which control fluid pressure is communicable, a. a housing connectible in a well tubing string, the housing having opposite ends, b. a main valve and an actuator therefor having pressure receiving surfaces, the actuator carried by the housing for movement relative to the housing to displace the main valve between open and closed positions to control production fluid flow upwardly relative to the housing, c. pilot valve means carried by the housing and having a first position to block application of the control pressure that would act on the actuator to shift the main valve to open position at certain times when the control pressure exceeds the well fluid pressure, the pilot valve means being shiftable relative to the housing in response to an increase in the control fluid pressure and to a second position to unblock control pressure application acting to shift the main valve to open position at other times when the control pressure exceeds the well fluid pressure, and d. means to supply said control pressure to the pilot valve means.

2. The well valve of claim 1 wherein said pilot valve means comprises a vertically movable sleeve having an up-position in which control pressure is communicated to the main valve actuator tending to displace it to main valve closed position, and a down position in which control pressure is communicated to the main valve actuator to displace it to main valve open position.

3. The well valve of claim 2 wherein the pilot valve has a first piston surface to receive application of control pressure to shift the pilot valve to said down position when the control pressure exceeds a predetermined level.

4. The well valve of claim 3 including a spring normally urging the pilot valve into up-position, the spring sized to be overcome when said control pressure exceeds said predetermined level.

5. The well valve of claim 4 wherein the pilot valve has a second piston surface to receive application of control pressure tending to shift the pilot valve toward said up-position, the control pressure receiving effective area of said first piston surface exceeding the control pressure receiving effective area of said second surface.

6. The well valve of claim 2 wherein said pilot valve has oppositely facing surfaces exposed to receive production fluid pressure, the effective areas of said surfaces being equal so that the pilot valve is production fluid pressure balanced.

7. The well valve of claim 2 wherein the housing contains a passage by-passing the pilot valve and communicating with the tubing interior above and below the pilot valve.

8. The well valve of claim 7 wherein the main valve comprises a vertically movable sleeve having an up-position in which production fluid flow upwardly through said passage is unblocked, and a down-position in which upward flow through said passage is blocked.

9. The well valve of claim 8 wherein said actuator surfaces face oppositely to receive production fluid pressure, the effective areas of said surfaces being equal so that the main valve is production fluid pressure balanced.

10. The well valve of claim 8 including a carrier for said main valve and pilot valve, the housing removably receiving the carrier.

11. The well valve of claim 10 wherein the carrier includes tubular extent extending vertically between the main valve and pilot valve, the upper extent of the carrier forming a barrier adjacent upper extent of said passage.

12. The well valve of claim 10 wherein said passage includes multiple vertical openings spaced about the main valve and communicating with an annular flow port in the housing controlled by said main valve.

13. In a well valve, a. a housing connectible in a well tubing string, b. main valve means and an actuator therefor, the actuator carried by the housing for movement between main valve open and closed positions thereby to control the upward flow of production fluid in the well, c. pilot valve means carrier by the housing for movement between two positions in one of which control fluid pressure is passed to effect movement of the main valve means to open position, and in the other of which such passage of control fluid pressure is blocked, d. there being regulator means resisting movement of the pilot valve means to said one position until such time as the control fluid pressure is increased to predetermined level, and e. means to supply said control pressure to be passed and blocked by the pilot valve means.

14. The valve of claim 13 wherein the pilot valve is located interiorly of the housing.

15. The valve of claim 14 wherein the housing is tubular, and including a carrier within the housing and retrievable endwise therefrom, the pilot valve carried by the carrier.

16. The valve of claim 14 wherein the pilot valve is located exteriorly of the housing.

17. The valve of claim 16 including an auxiliary housing carried by said first mentioned housing, the pilot valve located within the auxiliary housing.

18. The valve of claim 17 including a single control line for said control fluid pressure, there being a well tubing string supporting said control line and connected with said housing, in a well.

19. In a well valve, a. a housing connectible in a well tubing string, b. a main valve movable in the housing between open and closed positions, the housing and main valve providing a vertically open straight bore in main valve open position, c. a control pressure responsive main valve actuator to displace the main valve between said positions, d. a control pressure responsive pilot valve carried by the housing outside said bore to control application of control pressure to the actuator, and e. means to supply said control pressure for control as aforesaid by the pilot valve means.

* * * * *